US005139130A

United States Patent [19]

Boxall

[11] Patent Number: 5,139,130

[45] Date of Patent: Aug. 18, 1992

[54] DEVICE FOR GUIDING COINS

[75] Inventor: Stephen C. Boxall, Basingstoke, United Kingdom

[73] Assignee: Mars Incorporated, McLean, Va.

[21] Appl. No.: 761,937

[22] PCT Filed: Mar. 5, 1990

[86] PCT No.: PCT/GB90/00336

§ 371 Date: Oct. 10, 1991

§ 102(e) Date: Oct. 10, 1991

[87] PCT Pub. No.: WO90/11580

PCT Pub. Date: Oct. 4, 1990

[30] Foreign Application Priority Data

Mar. 17, 1989 [GB] United Kingdom ..... 8906143

[51] Int. Cl.[5] ..... G07F 1/04

[52] U.S. Cl. ..... 194/346; 193/31 A

[58] Field of Search ..... 194/346; 193/DIG. 1, 193/23, 31 R, 31 A; 453/3; 221/68, 252

[56] References Cited

U.S. PATENT DOCUMENTS 4,082,099 4/1973 Iwersen ..... 194/317

4,263,924 4/1981 Johnson ..... 194/337 X

FOREIGN PATENT DOCUMENTS 3512579 10/1986 Fed. Rep. of Germany .

1580430 9/1969 France .

1058772 2/1967 United Kingdom .

1066389 4/1967 United Kingdom .

1486519 9/1977 United Kingdom .

2201825 9/1988 United Kingdom .

2205429 12/1988 United Kingdom .

*Primary Examiner*—F. J. Bartuska

*Attorney, Agent, or Firm*—Davis Hoxie Faithfull & Hapgood

[57] ABSTRACT

A device for guiding a coin arriving in an entry (6) of the device to a selected one of a plurality of exits (12) of the device, comprising a movable guide (14) having a plurality of inlets (16) each leading to a common outlet (18), the guide being movable to position the outlet in register with any selected one of the exits, and the inlets being so arranged that one of them is in a position to admit a coin arriving through the entry irrespective of the position of the guide, whereby the coin is guided from the one inlet via the common outlet to the selected exit.

7 Claims, 2 Drawing Sheets

DEVICE FOR GUIDING COINS

Figure 1A:
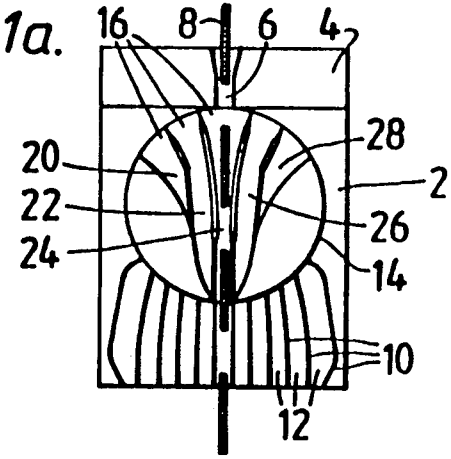
Figure 1B:
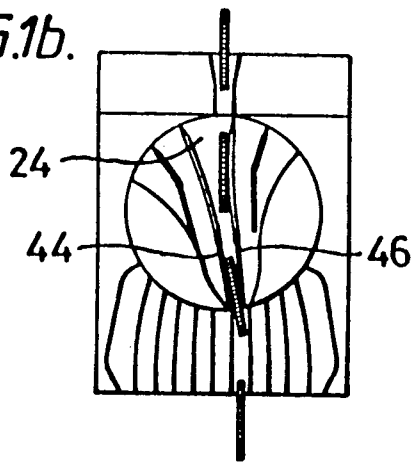
Figure 1C:
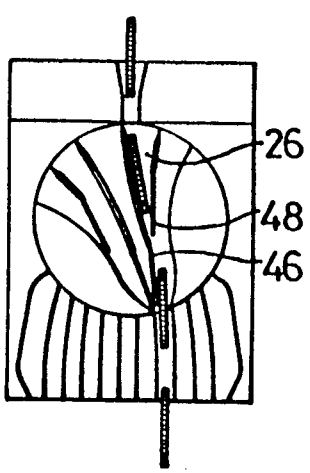
Figure 1D:
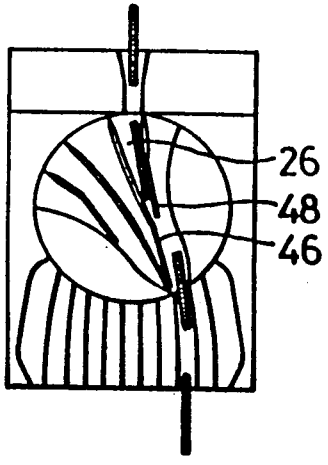
Figure 1E:
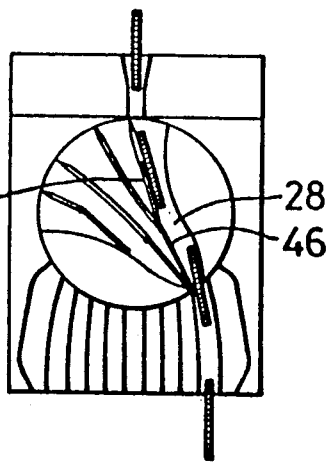
Figure 1F:
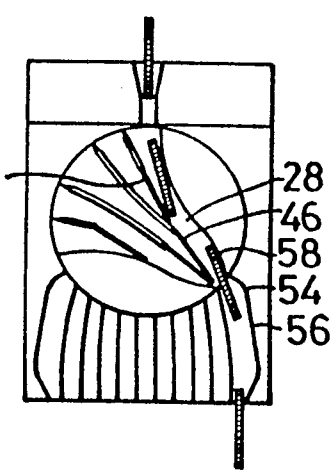

This invention relates to devices for guiding coins, to different and selectable paths after they have arrived at the device on substantially the same path.

The particular device to be described is designed specifically for guiding coins which have been validated by an electronic coin validator to different paths which respectively lead to different storage locations each for a particular denomination of coin. In that situation, the validator will determine the denomination of the coin, and the validator will control the guiding device so that it will deliver that coin to the path which leads to the correct storage location for coins of that denomination.

There is a requirement for different coin denominations to be stored separately, in coin mechanisms which have to give change, for example in vending machines, and in coin mechanisms which have to pay out prizes, for example in gaming machines.

Devices for separating incoming coins onto different paths have generally been referred to as coin sorters and include passive types and active types. In passive coin sorters, such as window sorters, the path of the coins is provided with fixed mechanical features so designed that coins of different denominations, because of their different dimensions, will depart from the path at different points and thereafter will travel to different storage locations. As the number of different denominations to be sorted increases, it becomes more and more difficult to design passive sorters that will operate reliably, and they become undesirably large. In active coin sorters, typically a group of independently solenoid actuated gates is provided which can be switched into different configurations to divert an incoming coin onto anyone of a number of outlet paths. These also tend to become bulky as the number of coin denominations to be sorted increases, and the plurality of actuators required makes them fairly costly and increases the chance of mechanical or electrical failure.

The present invention aims to provide an active coin sorter which is compact, especially in height, relatively simple in construction, and capable of sorting coins onto a relatively large number of paths.

FR-A-158430 discloses a device in which arriving coins are initially stopped, and then are either returned to a customer or directed into a coin storage system, by means of an element which swings to and fro below a coin entry about an axis located above the coin entry.

The invention provides a device for guiding a coin arriving in an entry of the device to a selected one of a plurality of exits of the device, comprising a movable guide having a plurality of inlets each leading to an outlet, the guide being movable to position said outlet in register with any selected one of said exits, and said inlets being so arranged that one of them is in a position to admit a coin arriving through said entry irrespective of the position of the guide, whereby said coin is guided from said one inlet via the common outlet to the selected exit, characterised in that the inlets lead to a common outlet and the movement of the guide comprises a rotational movement about an axis between the entry and the exits.

Figure 2:
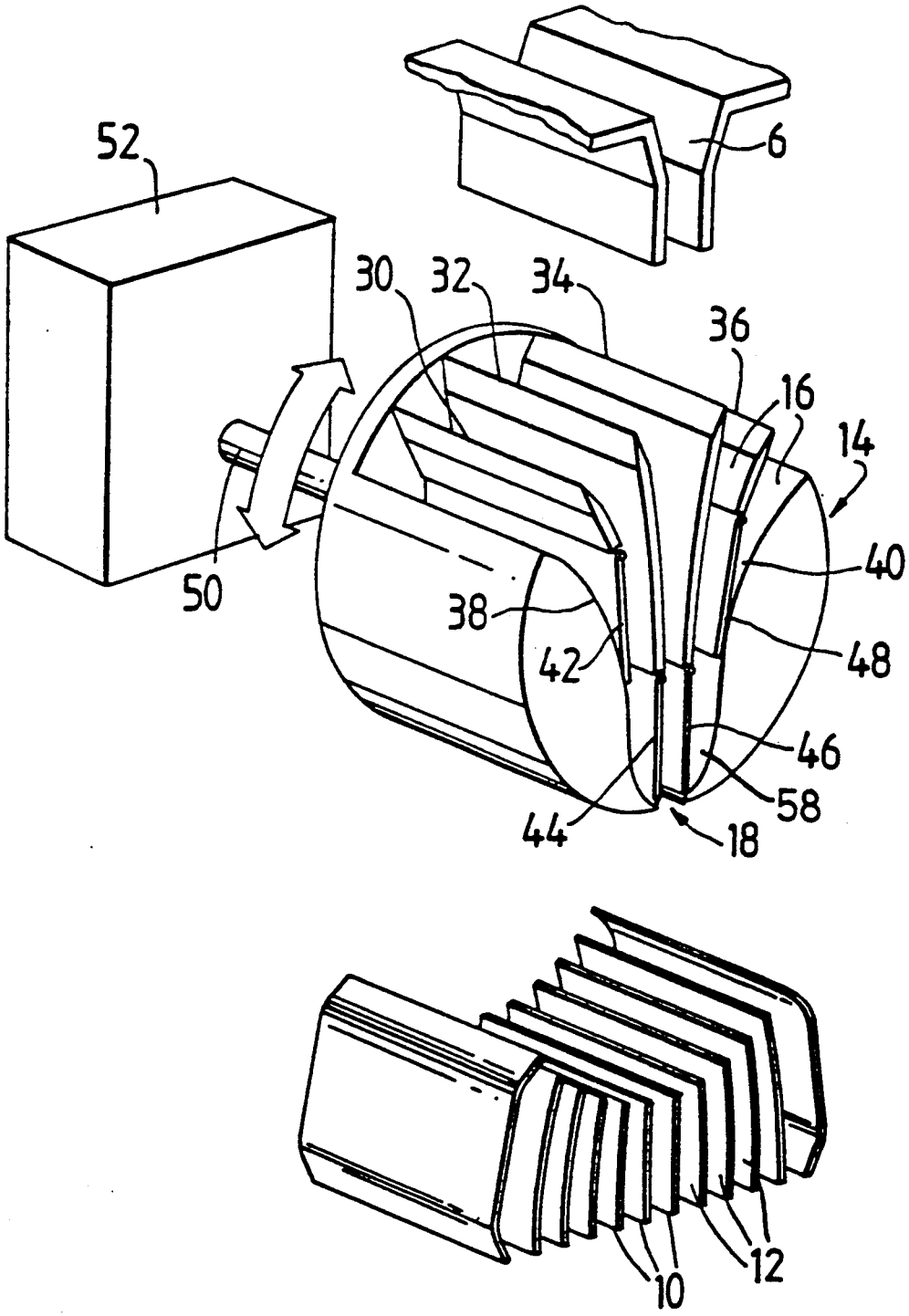

In order that the invention may be more clearly understood, a preferred embodiment will be described, by way of example, with reference to the accompanying diagrammatic drawings in which:

FIGS. 1(*a*) to (*f*) show a coin guiding device in accordance with the invention set to respective different positions in order to guide incoming coins to different paths, and FIG. 2 is a perspective view of components of the device shown in FIG. 1.

Referring to FIGS. 1(*a*) and 2, the device comprises a support plate 2 the upper part 4 of which projects forwardly and is formed with an entry 6 for arriving coins 8.

A plurality of vanes 10 are fixed to the front of the support plate 2 near its lower end and define between them eleven exits of the device in the form of passageways 12. A different number of exits may of course be provided.

The device further includes a generally drum-like rotatable guide 14 having a plurality of (in this case five) inlets 16 each leading to a common outlet 18. Guidance channels 20, 22, 24, 26, and 28 lead into the guide 14 from the respective inlets 16 to the common outlet 18.

The upper ends of the guidance channels are defined by four fixed blades 30, 32, 34 and 36, of which the two inner blades 32 and 34 are the longer and the outer blades 30 and 36 are shorter, in conjunction with the curved wall surfaces 38 and 40 on the main body of the guide 14.

It can be seen from the drawings that the guidance channels 20, 22 and 26, 28 merge with each other below the blades 30 and 36, and that the two merged outer channels thus formed then merge, in turn, with the central guidance channel 24 below the longer blades 32 and 34 so that in effect all channels combine at the common outlet 18.

In the region where adjacent channels merge with each other trailing (that is to say trailing with respect to the direction of coin travel through the device) flaps 42, 44, 46 and 48 are provided, these being freely pivoted at the lower edges of the respective blades 30, 32, 34 and 36.

Referring to FIG. 2, the guide 14 is mounted at the end of the output shaft 50 of a stepper motor 52. The motor 52 is fixed in any suitable way to the rear of the support plate 2 of the device, with the shaft 50 extending through an aperture in the support plate 2 to carry the guide 14 in front of the support plate. These mechanical details are not illustrated in the drawings because they do not themselves form part of the invention and can be effected using very well known techniques, as also can the electronic control circuitry used to cause the stepper motor 52 to selectively position the guide 14 with its common outlet 18 in register with any desired one of the eleven exit passageways 12.

FIGS. 1(*a*) to 1(*f*) show the guide 14 positioned with the common outlet 18 in register sequentially with the middle one of the eleven exit passageways 12 through to the extreme right-hand one of the exit passageways 12. By step-wise rotation of the motor 52 in the opposite direction, the common outlet 18 can, of course, be positioned in register with the exit passageways 12 lying to the left of the middle one. The trailing flaps 42, 44, 46 and 48 are intended to be pivoted freely enough to hang under the force of gravity but if they do stick slightly, they can be brushed aside by an incoming coin. The effect of the flaps, as can be seen by inspecting the various views in FIG. 1, is to provide continuity from entry 6 to exit 12 of whichever channel within the guide 14 the particular coin is passing through. For example, in FIG. 1(*a*), the flaps 44 and 46 (see FIG. 2 for these reference numerals) are providing continuous side walls for the central channel 24; in FIG. 1(*b*) the flap 44 is providing a continuous side wall down which the coin can slide, again in central guidance channel 24; in FIG. 1(*c*), flap 46 is providing a continuous side wall for guidance channel 26, and similarly in FIG. 1(*d*); in FIG. 1(*e*), the trailing flaps 48 and 46 are in succession providing a continuous wall for the coin to slide on in guidance channel 28, as they are also in FIG. 1(*f*). It will be appreciated that the operation of the trailing flaps is in symmetrical manner when the guide 14 is rotated clockwise instead of anti-clockwise. It can also be seen from FIG. 1 that the trailing flaps do not obstruct channels. For example, the flap 46 is simply being pushed aside by the coin in the central channel in FIG. 1(*b*), as is the flap 48 by the coin in guidance channel 26 in FIGS. 1(*c*) and 1(*d*).

FIGS. 1(*a*) to 1(*f*) show how the guidance channels, including the trailing flaps, are configured so that each of them will provide a relatively smooth non-angular path of travel for a coin from the entry 6 to the selected exit passageway 12, when the particular channel is the one being used to route the coin.

All the components along the coin path through the device are dimensioned to keep coins travelling edgeways without tumbling. The coins will tend to emerge from the common outlet 18 in different directions for different rotary positions of the guide, as can be seen from FIG. 1. To further smooth the path of the coin the exit passageways 12 are profiled, by profiling the vanes 10 which define them. This profiling is most pronounced in the case of the outer extreme vanes 10, as can easily be seen from FIGS. 1 and 2, and becomes less pronounced for the vanes 10 progressively towards the centre. Referring to FIG. 1(*f*), it can been seen that the pronounced outward bulge 54 near the upper end of the extreme right-hand vane 10 allows plenty of room for the leading edge of a coin to enter well into the exit passageway and then to be relatively gently turned clockwise by contact with the lower and straighter part 56 of the vane. It can also be seen that the concavity 58 of the wall 40 in its lower region adjacent the common outlet 18 permits the trailing edge of the coin to swing clockwise as the coin turns.

This profiling of the exit passageways ensures minimal hindrance of the coins as they leave the guide 14 and enter into the respective passageway 12 and hence reduces the time which must be allowed to elapse before the guide is re-positioned for sorting of the next coin. The non-angular shapes of the paths through the guide 14 itself have the same effect. Consequently, both features contribute towards enhancing the throughput of the sorting or guiding device in terms of coins per unit time.

The profiling of the vanes 10 is extended downwards so that at the bottom of the device, where the coins are seen emerging, they are all travelling in substantially the same direction, namely vertically edgewise, and although their paths are laterally separate, they are nevertheless close together, which makes for compactness.

In the embodiment that has been described, and as can be seen from FIG. 1, the central inlet 16 remains in register with the entry 6 for all three of the most central positions of the common outlet 18, while each of the non-central inlets is in register with the entry 6 for two different adjacent positions of the common outlet 18. Thus, an acceptably smooth path to each of the eleven exit passageways can be provided without requiring a separate guidance channel through the guide 14 for each of its different positions, though it would be feasible to do this, but at the expense of greater structural complexity.

Although in the embodiment described the coin entry 6 and the exit passageways 12 are incorporated as part as the same physical unit as the rotary guide 14, it will be appreciated that the entry and the exits could be, or could be part of, different units from the guide 14 though of course they would cooperate with it in the operation of the sorting or guiding device as a whole.

I claim:

1. A device for guiding a coin arriving in an entry of the device to a selected one of a plurality of exits of the device, comprising a movable guide having a plurality of inlets each leading to an outlet, the guide being movable to position said outlet in register with any selected one of said exits, and said inlets being so arranged that one of them is in a position to admit a coin arriving through said entry irrespective of the position of the guide, whereby said coin is guided from said one inlet via the common outlet to the selected exit, characterised in that the inlets lead to a common outlet and the movement of the guide comprises a rotational movement about an axis between the entry and the exits.

2. A device as claimed in claim 1 wherein at least one inlet is large enough to be in a position to admit a coin from said entry when the guide is positioned with said outlet in register with either of two adjacent exits.

3. A device as claimed in claim 1 or claim 2 wherein a guidance channel leads into the guide from each inlet towards the common outlet.

4. A device as claimed in claim 3 wherein adjacent guidance channels merge with each other towards the common outlet and, in the region where they merge, a trailing flap is provided between them to provide continuity to one of the adjacent channels without obstructing the other of them.

5. A device as claimed in claim 3 wherein the guidance channels are configured to provide a relatively smooth non-angular path of travel for a coin from the entry to each of the exits.

6. A device as claimed in claim 1 wherein coins will tend to emerge from the common outlet in different directions for different rotary positions of the guide, and at least some of the exits comprise passageways which are profiled to admit the coin travelling in its direction of emergence and to redirect it, such that coins will leave all the passageways travelling in substantially the same direction.

7. A device as claimed in claim 1 having its entry at the top and its exits at the bottom whereby the coin is guided while moved by gravity through the device.

* * * * *